US009380923B2

(12) United States Patent
Jordan et al.

(10) Patent No.: US 9,380,923 B2
(45) Date of Patent: Jul. 5, 2016

(54) MULTI-PURPOSE TOOL

(71) Applicant: REJ, LLC, Lynn, MA (US)

(72) Inventors: Robert E. Jordan, Lynn, MA (US); Marcel Thivierge, Boxford, MA (US)

(73) Assignee: KID WINTHORPE, LLC, Lynn, MA (US)

( * ) Notice: Subject to any disclaimer, the term of this patent is extended or adjusted under 35 U.S.C. 154(b) by 88 days.

(21) Appl. No.: 14/481,629

(22) Filed: Sep. 9, 2014

(65) Prior Publication Data

US 2016/0066762 A1 Mar. 10, 2016

(51) Int. Cl.
*A47L 13/12* (2006.01)
*A46B 15/00* (2006.01)

(52) U.S. Cl.
CPC ..... *A47L 13/12* (2013.01); *A46B 15/0055* (2013.01)

(58) Field of Classification Search
CPC ..... A46B 15/0055
USPC ..... 15/105, 106, 110, 111, 114, 117, 118, 15/121, 236.01, 236.05, 231, 232, 245, 15/209.1, 210.1, 228
See application file for complete search history.

(56) References Cited

U.S. PATENT DOCUMENTS

| | | | | | |
|---|---|---|---|---|---|
| 520,731 | A * | 5/1894 | Fisher | A45D 24/40 | 15/104.5 |
| 4,240,176 | A * | 12/1980 | Farmer | A47L 1/06 | 15/117 |
| 5,410,772 | A * | 5/1995 | Lewis | A47L 13/20 | 15/106 |
| 5,822,825 | A * | 10/1998 | West | A47L 1/16 | 15/236.01 |
| 6,925,675 | B1 * | 8/2005 | Trunecek | A47L 1/16 | 15/236.01 |
| 2013/0104329 | A1 * | 5/2013 | Schouten | B08B 1/00 | 15/121 |

* cited by examiner

*Primary Examiner* — Laura C Guidotti
(74) *Attorney, Agent, or Firm* — Coleman & MacDonald Law Office

(57) ABSTRACT

A multipurpose tool including a frame defining a first edge, a second edge and a third edge joined one to the other at the ends thereof to form an enclosure. The tool including a center portion coupled to each of the first, second and third edges, and having a first tool coupled to the first edge, a second tool coupled to the second edge; and a third tool coupled to the third edge. A grip being attached to the center portion. A multi-purpose tool kit is provided comprising a multi-purpose tool and a plurality of pads, each pad being configured to removably attach to an edge of the multi-purpose tool.

14 Claims, 10 Drawing Sheets

SECTION D-D

SECTION C-C

SECTION E-E

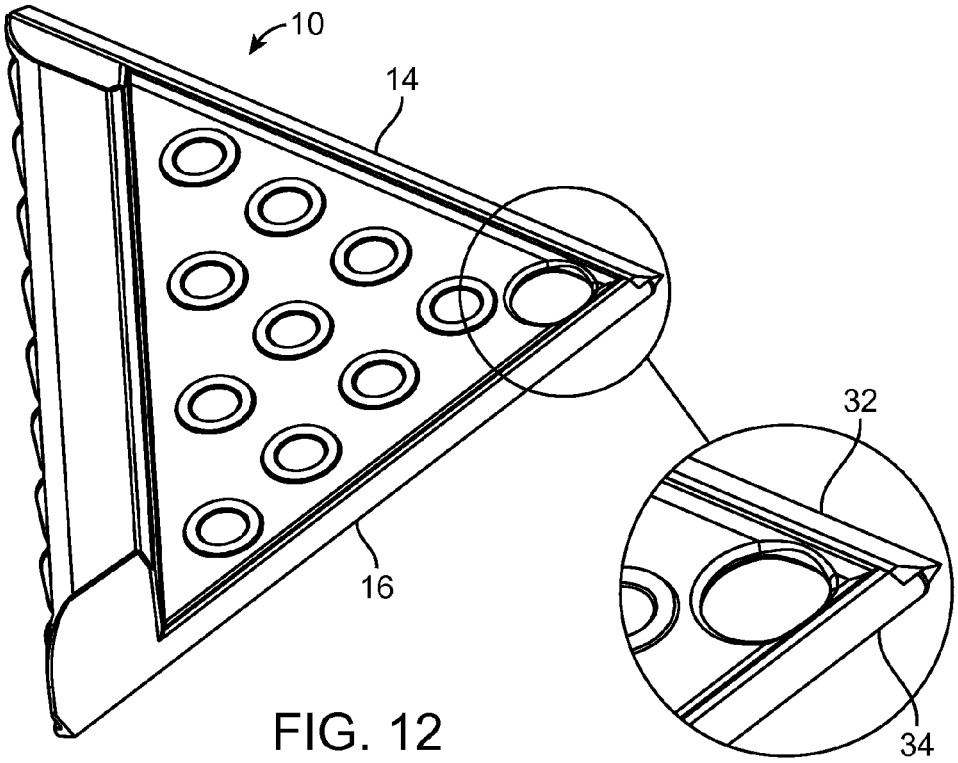
FIG. 12
FIG. 12a
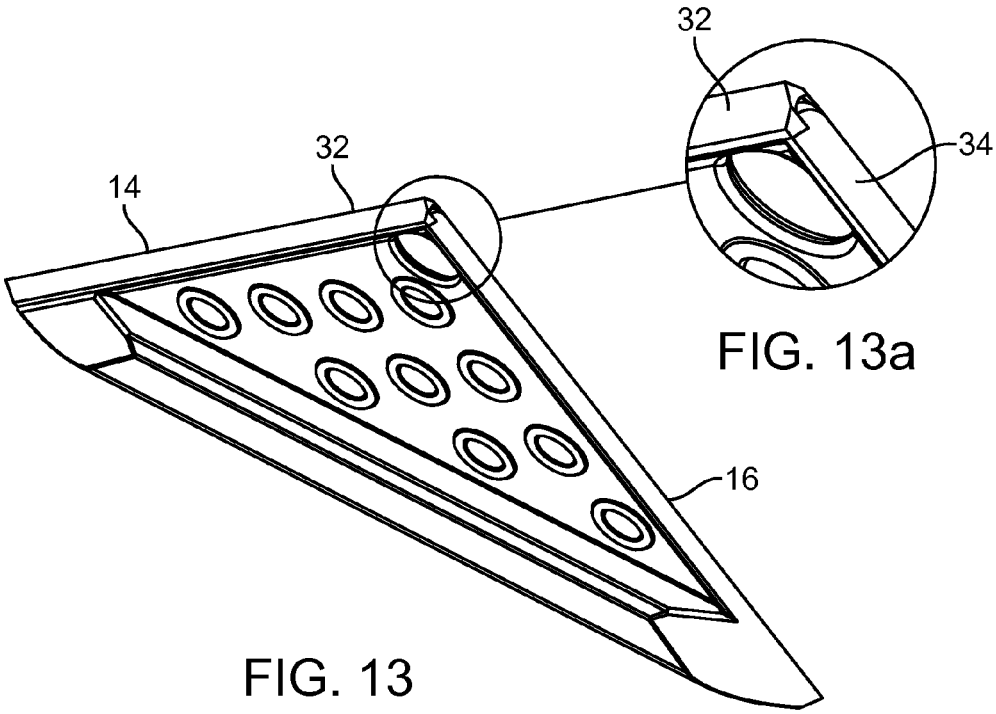
FIG. 13a
FIG. 13

MULTI-PURPOSE TOOL

BACKGROUND

1. Field of the Invention

Example embodiments generally relate to a multi-purpose tool for use in various industries and household applications. In one embodiment, the multi-purpose tool includes a frame defining three edges coupled one to the other to form a triangle. Each of the edges defines a tool, or a tool holder for supporting a tool. The multi-purpose tool including three tools, one each coupled to an edge of the frame.

2. Description of Related Art

Generally, various hand tools are well known in the art. Multi-purpose tools are also available in the prior art, however, current multi-purpose tools often include one or more tools which are interchangeably mounted to a handle. Thus, a user may be required to remove one tool from a handle and replace the tool with a second tool to use the second tool. This arrangement may be practical for certain types of tools, however, the process may require storing and/or keeping track of a plurality of tools separate from a handle. Also, the process may be inefficient for use on a task requiring multiple tools.

Other types of multi-purpose tools may include one or two tools coupled to a handle that is offset from the tools. Often the tools are generally flat and disposed on opposite sides of a tool base. A handle may be coupled to the tool base and extend outwardly therefrom. Generally this type of multi-purpose tool is limited to one or two tools coupled to a handle.

SUMMARY

Example embodiments are directed to a multipurpose tool having a frame defining a first edge, a second edge and a third edge, the edges joined one to the other at the ends thereof to form an enclosure. A substantially planar center portion is coupled to each of the first, second and third edges. The multi-purpose tool includes a first tool coupled to the first edge, a second tool coupled to the second edge, and a third tool coupled to the third edge. One embodiment of the multipurpose tool includes a center portion including a plate having first and second opposing sides and a grip mounted to at least one side of the plate. Another embodiment of the multipurpose tool includes wherein each of the frame and center portion are formed integral one with one the other. A further embodiment includes a multipurpose tool wherein the each of the first edge, second edge and third edge of the frame and the center portion are integrally formed as a single structure.

Additionally a multi-purpose tool kit is provided including a multi-purpose tool and a plurality of replacement pads, wipes or replaceable blades for use with the tool. Various kits include a multi-purpose tool and includes a plurality of pads, wipes or blades designed for one or more identified purposes.

BRIEF DESCRIPTIONS OF THE DRAWINGS

Example embodiments will become more apparent by describing, in detail, example embodiments thereof with reference to the attached drawings, wherein like elements are represented by like reference numerals, which are given by way of illustration only and thus do not limit the example embodiments herein.

FIG. 12 is an illustration of an example embodiment multi-purpose tool.

FIG. 12*a* is a detail view of a portion of FIG. 12 showing a juncture of a squeegee and scraper of the FIG. 12 embodiment.

FIG. 13 is an illustration of an example embodiment multi-purpose tool.

FIG. 13*a* is a detail view of a portion of FIG. 13 showing a juncture of a squeegee and scraper of the FIG. 13 embodiment.

Figure 14:
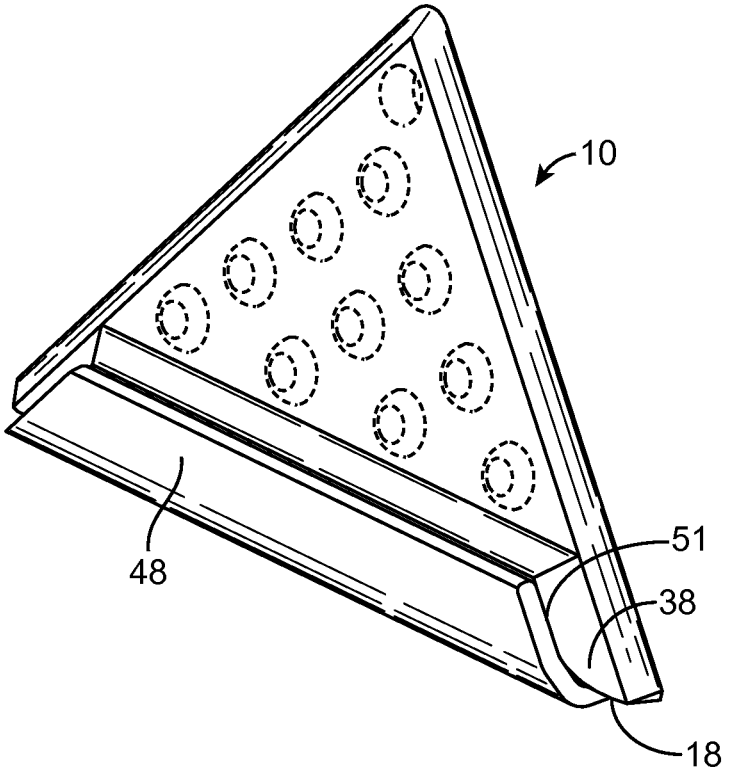

FIG. 14 is an illustration of an example embodiment multi-purpose tool shown with a micro-fiber pad coupled to one edge thereof.

Figures 15, 15A, 15B:
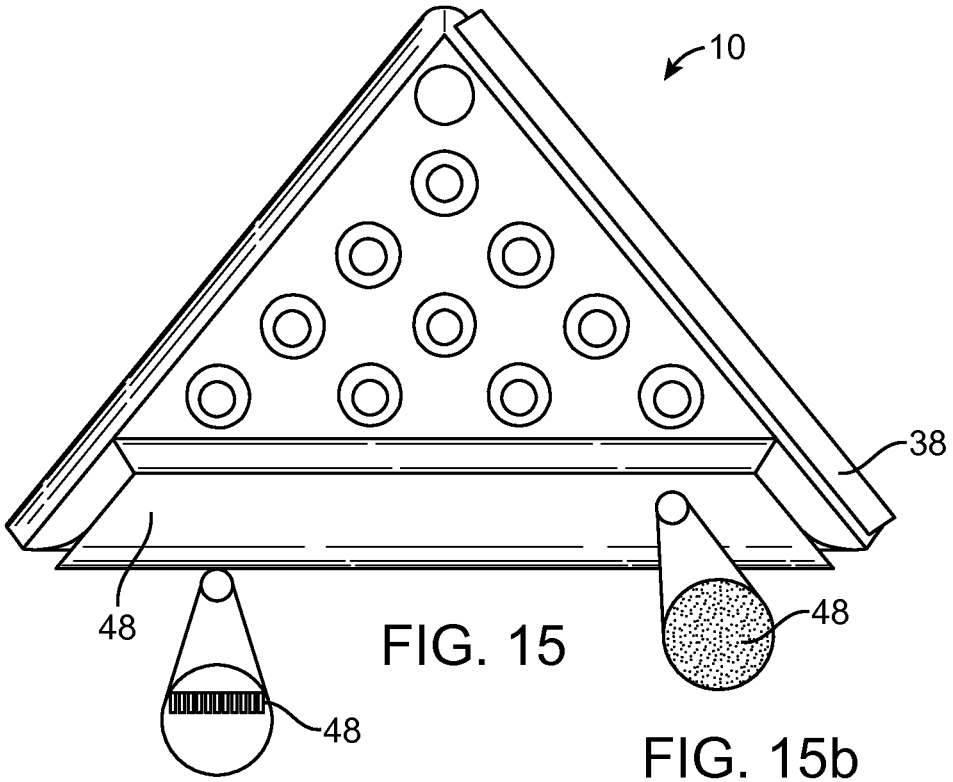

FIG. 15 is an illustration of an example embodiment multi-purpose tool shown with a micro-fiber pad coupled to one edge thereof.

FIG. 15*a* is a detail side view of the micro-fiber pad of FIG. 15.

FIG. 15*b* is a detail side view of the micro-fiber pad of FIG. 15.

Figure 16:
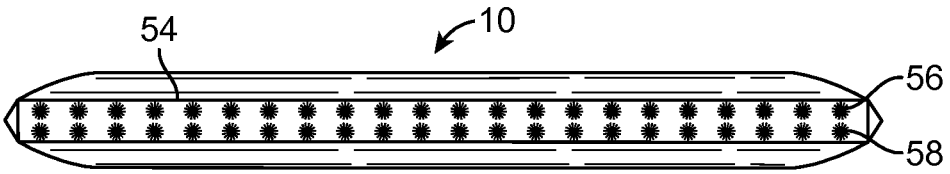

FIG. 16 is a bottom side view of an example embodiment multi-purpose tool including a brush coupled to an edge thereof.

Figure 17:
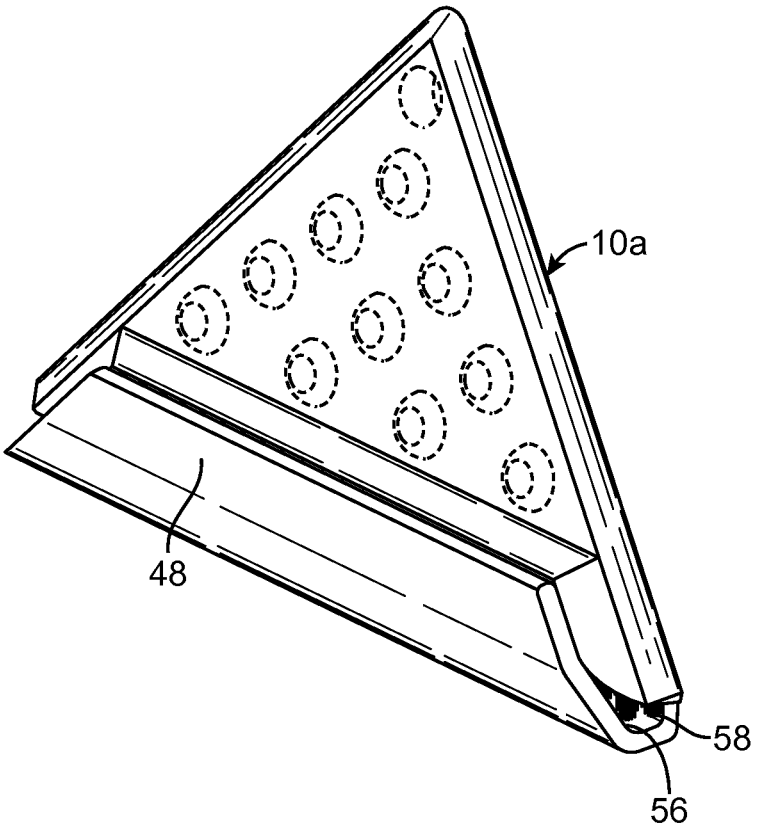

FIG. 17 is a perspective view of the multi-purpose tool of FIG. 16 shown including a micro-fiber pad coupled to the tool over the brush.

Figure 1:
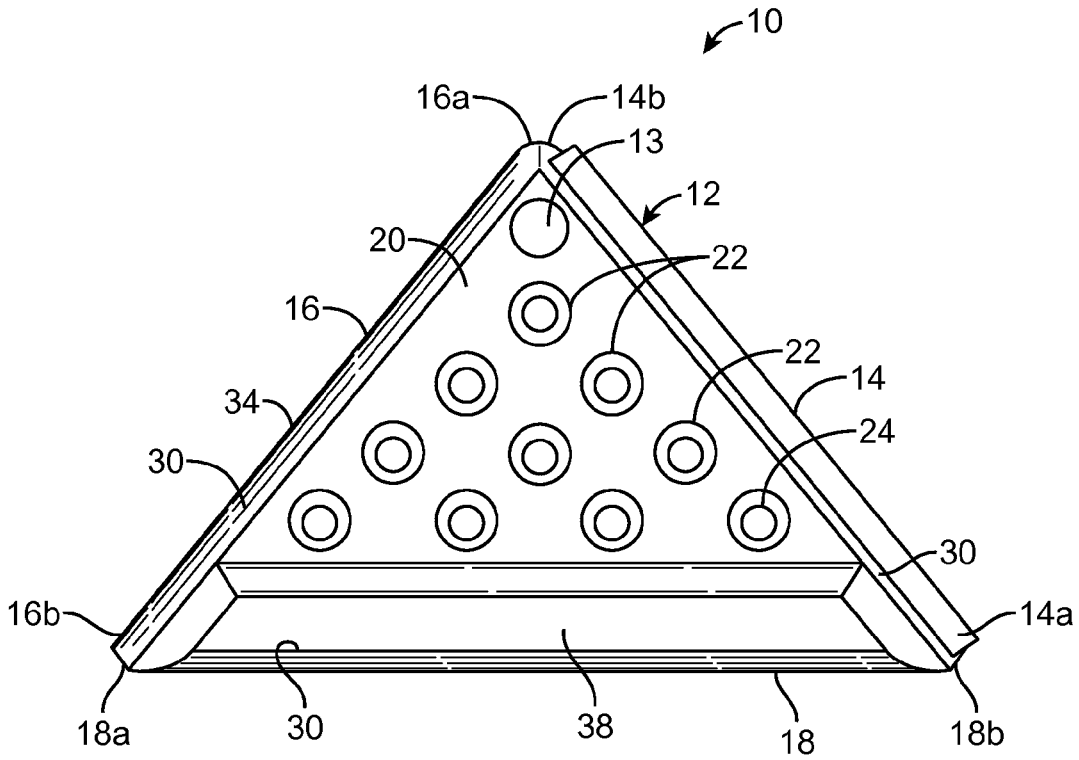
FIG. 1 is an illustration of an example embodiment multi-purpose tool.
Figure 18:
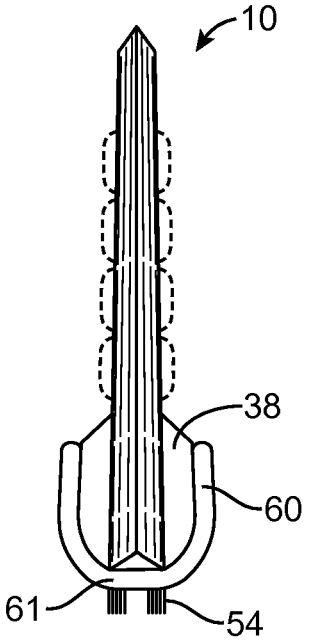

FIG. 18 is an end view of another example embodiment multi-purpose tool including a brush coupled to a tool holder attached to a shoulder of the tool of FIG. 1.

DETAILED DESCRIPTION

Detailed illustrative embodiments of example embodiments are disclosed herein. However, specific structural and functional details disclosed herein are merely representative for purposes of describing example embodiments. The example embodiments may, however, be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

FIG. 1 illustrates an example embodiment multi-purpose tool 10. The tool 10 includes a frame 12 having a first edge 14, a second edge 16, and a third edge 18. The first edge 14 defines first and second ends 14*a*, 14*b* respectively. Similarly, the second edge 16 defines first and second opposing ends 16*a* and 16*b* respectively, and the third edge 18 defines first and second opposing ends 18*a* and 18*b*, respectively. As shown in the FIG. 1 embodiment, the second end 14*b* of the first edge 14 is joined to the first end 16*a* of the second edge 16, the second end 16*b* of the second edge 16 is attached to the first end 18*a* of the third edge 18. The second end 18*b* of the third edge 18 is attached to the first end 14*a* of the first edge 14. The first, second, and third edges 14, 16, 18 are coupled together end to end to form a closed frame 12. The FIG. 1 embodiment includes each of the first edge 14, the second edge 16 and the third edge 18 defining straight lines, wherein the frame 12 is triangular shaped.

Referring to FIG. 1, the frame 12 includes a generally planar center portion 20 disposed between and connected to each of the first, second and third edges, 14, 16, and 18 respectively. FIG. 1 shows the center portion 20 extending continuously along the entire length of each of the first, second and third edges (14, 16, 18) so that the center portion 20 of the frame 12 closes the area defined between the first, second and third edges 14, 16 and 18. The center portion 20 supports each of the first, second and third edges 14, 16, 18 and the edges 14, 16, 18 support the center portion.

In other embodiments (not shown) the tool 10 includes a center portion 20 which may not extend the entire length of each of the first, second and third edges 14, 16 and 18 respectively. For example, another embodiment, not shown includes a generally planar center portion attached to each of the first, second and third edges of the frame via a plurality of legs. The legs connected between the center portion and the frame. In one embodiment, the frame, center portion and legs are formed integrally to form a single structure. In one embodiment, the frame, center portion and legs are formed together in a single unit of a plastic material.

In one embodiment, the frame 12 including the first, second and third edges (14, 16, 18) and the center portion 20 are formed integrally from a plastic material. In other embodiments various other materials can be used for the frame 12 including metal, fiberglass, polymer, alloy, and/or composite materials. Alternatively, one or more of the first, second and third edges 14, 16 and 18 respectively, can be formed separately and coupled together to form the frame 12. The center portion 20 can be formed integral with the frame 12 or separately and coupled thereto.

The center portion 20 supports the first, second and third edges (14, 16, 18) of the frame 12 and provides a handle portion for grasping the tool 10 during use thereof. In one embodiment, the center portion 20 defines a thickness in a range of about 0.1 to about 0.375 inches depending on the application of the tool 10 so the center portion 20 will not flex too much or at all during use of the tool 10. In one embodiment designed for household cleaning applications the center portion defines a thickness in a range of about 0.08 inches to about 0.25 inches.

Referring to FIG. 1, a grip 22 is mounted to the center portion 20 of frame 12. The grip 22 is provided to enable a user of the tool 10 to securely grasp the frame 12 via the center portion 20. The grip 22 is preferably formed from a flexible or pliable material such as a rubber, foam, soft plastic or a composite material. The grip 22 is attached to the center portion 20 via an adhesive or a mechanical coupling.

Figure 2:
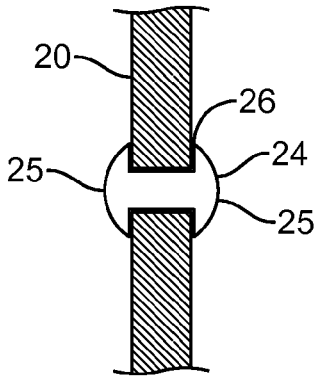
FIG. 2 is a detailed cross-sectional illustration of an embodiment of a center portion and grip of the multi-purpose tool of FIG. 1.

FIG. 1 includes the grip 22 comprising a plurality of dumbbell shaped inserts 24 coupled to the center portion via a plurality of through holes 26 defined by the center portion 20. FIG. 2 shows a cross section of the center portion 20 taken at one of the through holes 26. As shown in FIG. 2, a dumbbell shaped insert 24 is disposed in a corresponding hole 26 extending through the center portion 20. The insert 24 has a head 25 disposed adjacent each side of the center portion 20. A plurality of the inserts 24 coupled to the center portion 20 provides a grippable surface for grasping the frame with a hand of the user. The flexible inserts 24 allow a user to grasp the tool 10 for an elongated time while minimizing fatigue in a grasping hand.

In other embodiments the grip 22 may include a plurality of buttons (not shown) attached to the center portion 20 on more or both surfaces thereof via an adhesive. Alternatively, a one-piece grip may be attached to one or both sides of center portion 20 for providing a surface whereby a user can securely grasp the frame 12.

Figure 6:
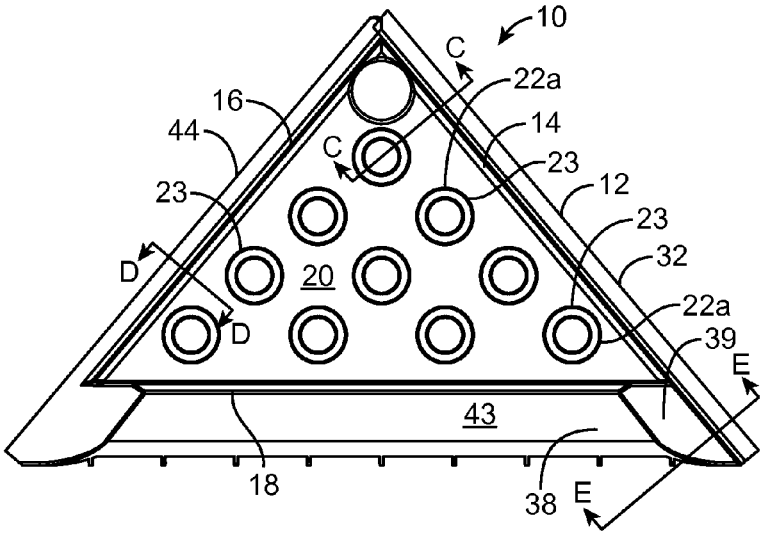
FIG. 6 is a front side view of an example embodiment multi-purpose tool.

Referring to FIG. 6, the center portion 20 includes a plurality of grips 22A disposed on one or both sides thereof. The grips 22A each comprise a cylindrical shaped protrusion 23 extending outwardly from a surface 21 of the center portion 20. The protrusions 22A may be formed integral with the center portion 20 and of the same material as the center portion. In the FIG. 6 embodiment there is no aperture or opening interior the cylindrical shaped protrusions 23. Thus, the center portion 20 is generally planar extending continuous between an interior of the edges 14, 16, and 18 of frame 12 and without any openings in the center portion. In other embodiments, the protrusions 23 may define protrusions shaped as squares, triangles, or other shapes such as non-uniform shapes. Regardless of the shape of the protrusion 23, the grip 22A provides a structure for facilitating grasping the center portion of frame 12 by a user thereof.

Still referring to FIG. 1, each of the first edge 14, second edge 16 and third edge 18 of the frame 12 form a tool and/or a tool support 30 for a workman's tool. Any of a plurality of tools can be coupled to and supported by the edges 14, 16, 18 of the frame 12. The tools are arranged on the frame 12 so as to be useable one at a time against a work surface (not shown). For example, the tool 10 of FIG. 1 shows a squeegee 32 coupled to the first edge 14 and a scraper 34 defined by the second edge 16. In the FIG. 1 embodiment, the second edge 16 does not include a tool support 30 as the second edge 16 defines a scraper and thus the second edge 16 also forms the work tool, namely scraper 34. The third edge 18 defines a shoulder 38 for supporting a wipe 40 (See FIG. 3). The FIG. 1 embodiment includes a surface area defined by the shoulder 38 being larger than a surface area of the other of the tool support 30 defined by the first edge 14 and the second edge 16.

Depending on the application for which it is designed, the tool 10 can include one or more various tools and combinations thereof. For example, the tool 10 can include various scrapers, including a plastic scraper, metal scraper, razor blade, rubber blade, squeegee blade, serrated edge blade, saw blade, etc. coupled to one or more of the first, second and third edges 14, 16, 18 thereof. Alternatively, one or more of the edges can support one of a micro-fiber cloth, a wipe, a pad, a cloth, an absorbent cloth, a scuff pad, an abrasive pad, a polishing cloth, a cotton cloth, an applicator pad. Further, the edges 14, 16 and 18 can be configured to support one of a brush, a wire brush, a dust brush, a crumb brush, a bristle brush, a brass brush, and/or other types of brushes. One or more of the edges 14, 16, 18 can include the same type of tool. One or more of the edges can be blank and include no tool.

An opening 13 defined by the center portion 20 is positioned near a corner of the center portion for use in hanging the tool 10 on a hook or other device for storing the tool. The opening 13 can be configured to receive a looped strap (not shown) for removably securing the tool to tool belt or other type of tool holder.

Figure 4:
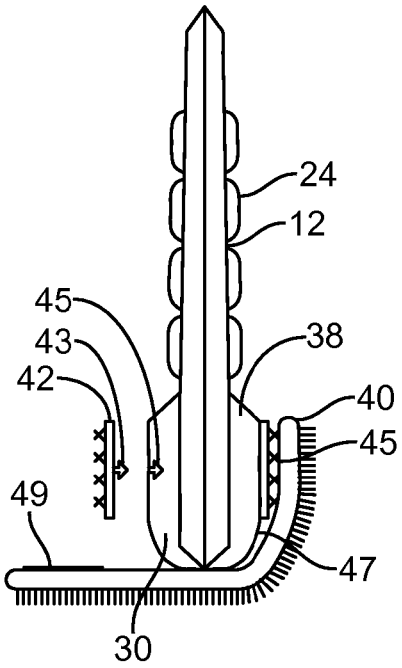
FIG. 4 is an end view of an embodiment of a multi-purpose tool including details of a fastener coupling a pad to a tool support thereof.
Figure 5:
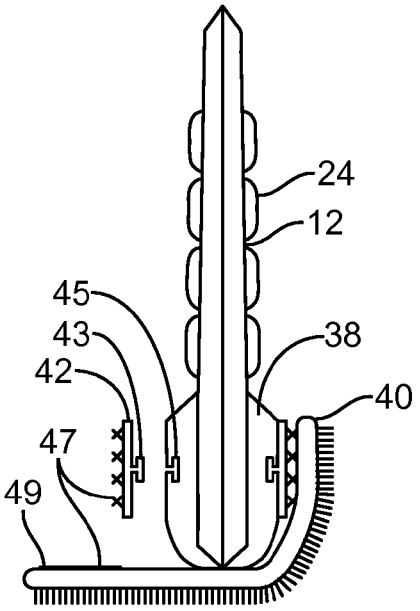
FIG. 5 is an end view of an embodiment of a multi-purpose tool including details of a fastener coupling a pad to a tool support thereof.

As shown in FIGS. 4 and 5, the edges 14, 16, and 18 can include a fastener 42 or coupler for attaching a pad 40 or other tool to the multi-purpose tool 10. FIGS. 4 and 5 show a fastener 42 coupled to a shoulder 38 defined by the third edge 18. The fastener 42 is attached to the shoulder 38 via a pin 43 and corresponding receiver 45. A mating fastener 49 is fixed to the pad 40 for connecting the fasteners 42 and 49 one to the other for coupling the pad 40 to the shoulder 38. In other embodiments the fastener 42 may be attached to the shoulder 38 via an adhesive or other type of fastener. In one embodiment, a Velcro® fastener 42 is attached to the shoulder 38 via ultrasonic weld or similar attachment. The fastener 49 may be fixed to the pad 40 via an adhesive or stitching. In one embodiment of the pad 40, the fastener 49 is omitted as the fabric of the pad 40 is configured to connect directly with the fastener 42. The fastener 42 or other type of fastener can be configured to removably attach a blade, pad, or cloth to the tool support 30 such as with a hook and loop fastener 47, e.g. Velcro®. A mating fastener is provided on a rear side of the Alternatively, one or more rivots, pins or other types of fasteners may be used to fix a blade to the tool support 30.

Figure 7:
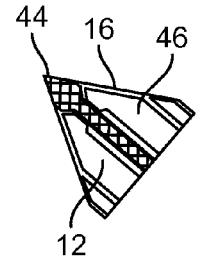
FIG. 7 is a detailed cross-section taken at line D-D of FIG. 6.

FIG. 6 shows another embodiment of the tool 10 including a squeegee 32 coupled to the first edge 14 and a scraper blade 44 mounted to the second edge 16. FIG. 7, shows a cross section at D-D of the second edge 16 showing a detail drawing of a groove 46 defined by the second edge 16 of the frame 12 for supporting a scraper blade 44. The scraper blade 44 is coupled to the fastener via the groove 46 defined by the frame 12. In one embodiment, the frame 12 is formed about the blade 44. Alternatively, the blade 44 is inserted into and retained in the groove 46 in a snap-fit configuration. Other embodiments of the tool 10 include various configurations of a groove, slot or other receptacle such as groove 46 for carrying a tool such as a blade and coupling the same to one edge (14, 16, 18) of the frame 12.

Figure 3:
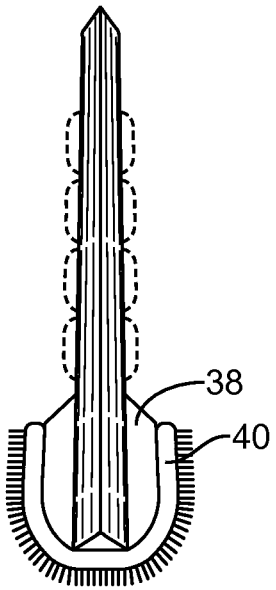
FIG. 3 is an illustration of example embodiment multi-purpose tool including a micro-fiber pad attached to a tool support thereof.
Figure 8:
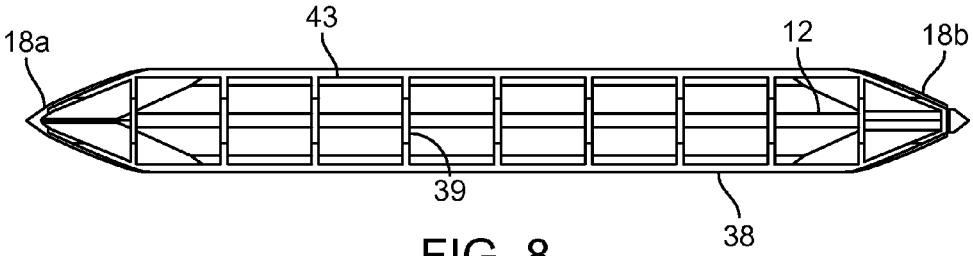
FIG. 8 is a bottom side view of the multi-purpose tool of FIG. 6.

FIG. 8 shows a bottom side view of a shoulder 38 defined by third edge 18 of the frame 12. The shoulder 38 is formed in part by ribs 39 formed perpendicular to and joined to opposing side walls 43 of the shoulder 38. As shown in FIG. 8, the side walls 43 of shoulder 38 are tapered at the ends 18*a* and 18*b* of the third edge 18 to correspond to the width of the frame 12 at the first and second edges 14 and 16 thereof respectively. The shoulder 38 being configured to support a micro-fiber wipe 40 as shown in FIG. 3.

Figure 9:
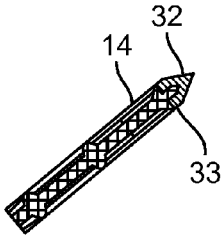
FIG. 9 is a sectional view of an embodiment of a squeegee taken at line C-C of FIG. 6.
Figure 10:
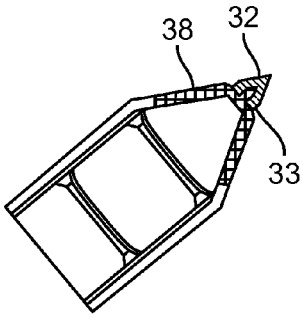
FIG. 10 is a sectional view of an embodiment of a squeegee taken at line E-E of FIG. 6.

FIGS. 9 and 10 shown cross-sections C-C and E-E of the squeegee 32 which extends substantially the full length of the first edge 14 including a portion of the end of the shoulder 38 as shown in FIG. 8. The squeegee 32 being coupled to a fastener 33 extending from and defined by the first edge 14 including an end portion 39 of the shoulder 38. The squeegee 32 being formed about the fastener 33 and/or secured thereto via a chemical bond or other methods known to one skilled in the art.

Figure 11:
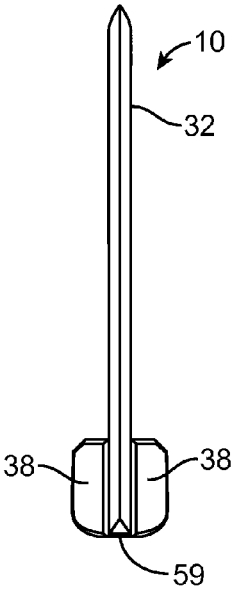
FIG. 11 is an end view of the embodiment of FIG. 6.

Referring to FIG. 11, an end view of the tool 10 of FIG. 6 shows a squeegee 32 extending a full length of the edge of the frame 12. As also shown in FIG. 11, the shoulder 38 defines a flat surface 59 at a lower edge thereof for supporting a pad or cloth in contact with a work surface (not shown).

Figure 11A:
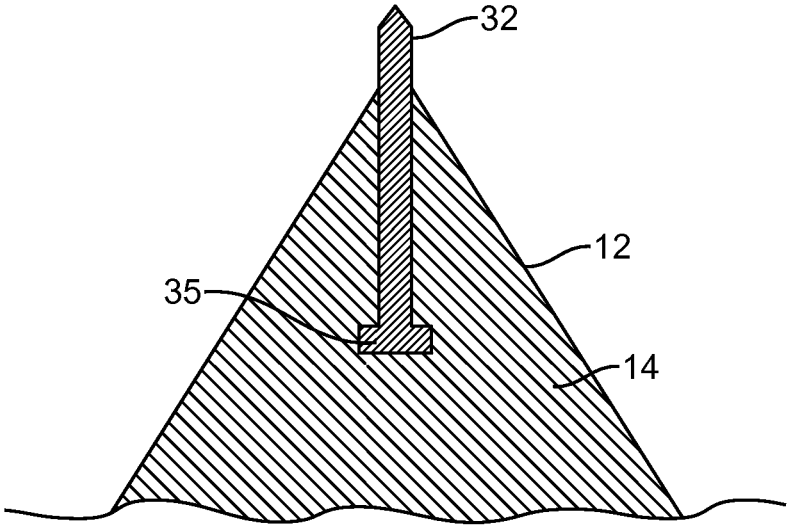
FIG. 11A is an illustration of an example embodiment of a squeegee coupled to one of the edges of the frame.

FIG. 11A shows a cross section of another embodiment of a squeegee 32 coupled to the frame 12 along the first edge 14 of the frame. The squeegee 32 defines a foot 35 for securely attaching the squeegee 32 to the frame 12. The frame 12 shown in the FIG. 11 embodiment may be formed around the squeegee and bonded thereto.

FIGS. 12 and 13 and corresponding detail views 12*a* and 13*a* respectively, show the tool 10 show having a squeegee 32 joined with a scraper 34 at the intersecting ends thereof being configured so that the squeegee extends the full length of the first edge 14 of the tool 12 and flush with a surface of the scraper 34 at the juncture of the meeting ends of the squeegee and scraper.

In some applications it may be important for the end of a squeegee 32 or other type of tool attached to the frame 12 to be configured to extend at least the full length of the frame 12 and/or slightly beyond the end of the frame 12 so the squeegee or other tool can be used in a corner of a workpiece or along an edge thereof. For example, when used for washing a window or on a countertop, it may be helpful to have the squeegee 32 extend at least to the end of the frame 12 or slightly beyond the end of the frame so the squeegee can be used against an end or corner of a window pane or counter top for cleaning a surface of the window pane or counter top. Similarly, other blades or pads may be configured to have an angled end so that the end of the blade or pad extends to the end of the frame 12 or slightly beyond an end of the frame 12. Accordingly, the tool such as squeegee 32 or a blade 31 may have an end thereof cut at an angle to facilitate using the tool in tight areas such as an end of a workpiece or in a corner.

Referring now to FIGS. 14, 15, 15*a* and 15*b*, one embodiment of a tool 10 includes a micro-fiber pad 48 coupled to the shoulder 38 of the third edge 18 of the tool 10. As shown, the micro-fiber pad 48 extends along an entire lower perimeter 51 of the shoulder 38 so that the micro-fiber pad 48 can contact a work surface while held in a hand of a user throughout a wiping motion. In the embodiment of the tool 10 shown in FIGS. 4 and 14, the lower perimeter 51 of the shoulder 38 defines a U-shaped surface for supporting the micro-fiber pad 48.

FIG. 15 shows the micro-fiber pad 48 mounted to the tool 10 and includes detail side views 15*a* and *b* showing the micro-fiber pad 48 from the side of the shoulder 38 and below the shoulder 38 respectively. Although a micro-fiber pad 48 is shown in the Figures, any type of pad of cloth or other types of materials can be attached to the shoulder 38 of tool 10 and supported thereby. As set forth above, the pad can be permanently or removably fixed to the shoulder 38.

In other embodiments of the tool 10 the shoulder 38 may define shapes other than a U-shaped lower perimeter depending on the pad being supported by the shoulder 38. For example, for an abrasive pad such as a scuff pad, the shoulder 38 may define a rectangular shaped generally flat lower surface to support a corresponding rectangular shaped surface of the pad attachable to the shoulder. A fastener 42 such as a hook and loop fastener may be coupled to the lower surface of the shoulder 38 for attaching a pad or other tool thereto.

FIG. 16 shows an embodiment of the tool 10 having a brush 54 extending outwardly from the shoulder 38. The brush 54 includes two generally parallel rows of bristles 56 and 58 extending substantially along an entire length of the third edge 18 of the tool 10. In other embodiments, the brush 54 may have bristles in other configurations. For example, a tool 10 designed for use by a waiter or in a kitchen may have a brush 54 designed to clear bread crumbs or other food particles from a table cloth, table top or counter. On the other hand a brush 54 for use as a masonry tool may include a brush having a fuller and/or longer set of bristles designed for use on bricks and mortar. Another embodiment (not shown) includes a brush for cleaning a keyboard. The keyboard brush having a plurality of soft bristles attached to a backing plate, the backing plate being fixed to a tool support 30 of the multi-purpose tool 10. Thus, depending on the proposed use of the multi-purpose tool 10, a brush 54 and/or the other tools coupled to each of the first edge 14, the second edge 16 and the third edge 18 may be designed to be used together and for a particular purpose. Accordingly, the configuration of, and materials used for the brush 54 and other tools coupled to the frame 12 are varied and otherwise known to one skilled in art.

Referring to FIG. 18, example embodiment tool 10 includes a shoulder 38 extending along a third edge 18 thereof. A tool holder 60 is shown coupled to an outer surface of the shoulder 38 in a snap-fit arrangement. A brush 54 extends outwardly from a lower surface 61 of the tool holder 60. Although not shown in FIG. 18, the brush 54 extends substantially along an entire length of the tool holder 60. The tool holder 60 is removably coupled to the third edge 18 and can be easibly be removed and replaced with a new tool holder 60 and brush or another tool holder 60 supporting a different tool.

Depending on the application, the tool holder 60 and associated brush 54 may extend substantially the entire length of the shoulder 38. Alternatively, for other applications, the brush 54 and tool holder 60 define a length less than the length of the shoulder 38 and occupy only a portion of the length of the shoulder 38 when attached thereto.

Although, not shown in FIG. 18, the tool holder 60 can include various other types of tools for coupling the same to the tool 10, e.g. blade tools, such as scrapers can be attached to the removable FIG. 17 shows another embodiment of a multi-purpose tool 10*a* according to the present disclosure having a brush 54 extending outwardly from the shoulder 38 as described hereinabove in connection with FIG. 16. The multi-purpose tool 10*a* also includes a micro-fiber pad 58 removably mounted over the brush 54 and attached to the shoulder 38 as discussed hereinabove. Accordingly, the tool 10*a* includes the brush 54 which can be used with or without the micro-fiber pad 58 attached over the bristles 56 and 58 of the brush 54.

As will be apparent to one skilled in the art, the size of the multi-purpose tool 10 described herein is variable based on the application for which it is designed. In one embodiment, the frame 12 forms an Isosceles triangle including the first and second edges having a length in a range of about 4 inches to about 7 inches and the third edge having a length in a range of about 6 inches to about 10 inches. In other embodiments the lengths of the first, second, and third edges can be shorter or longer.

In other embodiments the frame 12 and edges 14, 16 and 18 thereof can define an Equilateral triangle or a Scalene triangle. Thus, depending on a proposed application for the multi-purpose tool 10, the frame 12 and tools coupled thereto are design according to a specific function or In another embodiment a multi-purpose tool kit is provided including a multi-purpose tool 10 as shown and described herein along with a plurality of pads such as a wipe 40, micro-fiber pad 48 or micro-fiber pad 58. In one embodiment of a multi-purpose tool kit, five wipes and/or micro-fiber pads 40, 48, 58 are included so that a user can replace the wipes or pads if one of the pads becomes worn or dirty.

Typically the micro-fiber pad 48, 58 or wipe 40 can be made of a washable material wherein the pads can be washed and re-used. Other types of tools including abrasive pads, scuff pads or polishing pads may be washable as well or may require replacing with a new pad if the pad includes a wearing surface.

Example embodiments and methods thus being described, it will be appreciated by one skilled in the art that example embodiments and example methods may be varied through routine experimentation and without further inventive activity. For example, while the disclosure has addressed various configurations of a multi-purpose tool 10, other configurations and variations of the tool 10 are not to be regarded as departure from the spirit and scope of the exemplary embodiments, and all such modifications as would be obvious to one skilled in the art are intended to be included within the scope of the following claims.

What is claimed is:

1. A multipurpose tool comprising:

a frame defining a first edge, a second edge and a third edge joined one to the other at the ends thereof to form an enclosure;

a substantially planar center portion coupled to each of the first, second and third edges;

a first tool coupled to the first edge;

a second tool coupled to the second edge;

a third tool coupled to the third edge;

wherein one of the first, second and third edges defines a support surface extending along the length of the edge for supporting a wipe or cloth; the support surface defining a surface area larger than a surface area of the other of the edges; and a first fastener coupled to a side of the support surface, the first fastener being configured to connect with a second fastener coupled to a wipe for attaching the wipe to the support surface.

2. The multipurpose tool according to claim 1 wherein the first, second, and third edges of the frame form a triangle.

3. The multipurpose tool according to claim 1 wherein the center portion comprises a plate having first and second opposing sides and a grip mounted to at least one of the first and second sides.

4. The multipurpose tool according to claim 3 wherein the plate defines a plurality of holes, the grip comprising a plurality of inserts coupled to the plate via the holes.

5. The multipurpose tool according to claim 3 wherein the grip comprises a plurality of protrusions extending outwardly from the plate and formed integral therewith.

6. The multipurpose tool according to claim 1 wherein the frame and the center portion are formed integral one with the other.

7. The multipurpose tool according to claim 1 wherein the first tool comprises a scraper.

8. The multipurpose tool according to claim 1 wherein the second tool comprises a squeegee.

9. The multipurpose tool according to claim 1 further comprising a wipe attachable to the support surface via a second fastener coupled to the wipe.

10. The multipurpose tool according to claim 9 wherein the wipe comprises a micro-fiber cloth.

11. The multipurpose tool according to claim 1 wherein the first tool comprises a brush.

12. The multipurpose tool according to claim 1 wherein a brush is coupled to the support surface, the brush comprising bristles extending outwardly from the support surface, a wipe being attachable to the support surface over the bristles.

13. The multipurpose tool according to claim 1 wherein the first fastener is attached to the support surface via one of a chemical bond, a weld, an adhesive, and a fastener.

14. The multipurpose tool according to claim 1 wherein the first and second fasteners are hook and loop fasteners.

* * * * *